US007798835B1

(12) United States Patent
Lee et al.

(10) Patent No.: US 7,798,835 B1
(45) Date of Patent: Sep. 21, 2010

(54) ELECTRONIC CONNECTOR WITH PRESS-FITTED TERMINALS IN A BODY FLOATING ON A SUPPORT MEMBER

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 0 days.

(21) Appl. No.: 12/510,361

(22) Filed: Jul. 28, 2009

(30) Foreign Application Priority Data

Jun. 17, 2009 (TW) ..... 98210832 U

(51) Int. Cl.
*H01R 13/64* (2006.01)

(52) U.S. Cl. ..... 439/248

(58) Field of Classification Search ..... 439/248, 439/247, 246, 260, 374
See application file for complete search history.

(56) References Cited

U.S. PATENT DOCUMENTS

| | | | | |
|---|---|---|---|---|
| 6,146,184 | A * | 11/2000 | Wilson et al. | 439/374 |
| 6,196,856 | B1 * | 3/2001 | De Villeroche | 439/248 |
| 7,056,144 | B2 * | 6/2006 | Barsun et al. | 439/362 |
| 7,390,204 | B2 * | 6/2008 | Tanaka et al. | 439/159 |
| 7,611,056 | B2 * | 11/2009 | Sato | 235/441 |
| 2008/0268675 | A1 * | 10/2008 | Suzuki et al. | 439/82 |

* cited by examiner

*Primary Examiner*—Chandrika Prasad
(74) *Attorney, Agent, or Firm*—Rosenberg, Klein & Lee

(57) ABSTRACT

An electronic connector includes at least one support member having a curved top portion, an insulated body disposed above the support member, having a lower part formed with a curved sliding groove for receiving the curved top portion of the support member such that the insulated body is disposed floatingly on the support member, and two rows of first terminals respectively press-fitted to two side walls of the lower part confining the curved sliding groove. The first terminals have solder feet exposed to bottoms of the two side walls of the lower part.

7 Claims, 6 Drawing Sheets

ELECTRONIC CONNECTOR WITH PRESS-FITTED TERMINALS IN A BODY FLOATING ON A SUPPORT MEMBER

This application claims the benefit of the Taiwan Patent Application Serial NO. 098210832, filed on Jun. 17, 2009, the subject matter of which is incorporated herein by reference.

BACKGROUND OF THE INVENTION

1. Field of the Invention

The present invention relates to an electronic connector, more particularly to a memory card connector for connecting two memory cards to a base board (i.e., mother board or printed circuit board).

2. Description of the Prior Art

Due to rapid development in the electronic industry, the amount of memory card is in the increase. In order to facilitate mounting of the memory cards, a memory card connector has been invented which generally permits insertion of two memory cards therein.

FIG. 1 shows a perspective view of a conventional memory card connector PA100 for receiving double memory cards therein. As illustrated, the conventional memory card connector PA100 includes two rows of first terminals PA1*a* (only one row is visible in FIG. 1) and two rows of second terminals PA2*b* (only one row is visible in FIG. 1). The two rows of first and second terminals PA1*a*, PA1*b*, PA2*a*, PA2*b* cooperatively define two insert sides PA3, PA4 for respectively receiving two memory cards 200 (not shown) therein.

FIG. 1A is a cross-sectional view of the conventional memory card connector PA100 taken along lines A-A in FIG. 1. The solder feet PA11*a*, PA11*b* of the row of first terminals PA1*a*, PA1*b* and the solder feet PA21*a*, PA21*b* of the row of second terminals PA2*a*, PA2*b* are exposed to a bottom part of the memory card connector PA100 so that these exposed solder feet can be soldered to the electrical contacts on a base board 300 (generally a printed circuit board).

Sometimes, after mounting of the first and second terminals PA1*a*, PA1*b*, PA2*a*, PA2*b* in the memory card connector PA100, the solder feet PA11*a*, PA11*b*, PA21*a*, PA21*b* of the rows of first and second terminals PA1*a*, PA1*b*, PA2*a*, PA2*b* are exposed from the bottom part but are not aligned with one another along a horizontal direction, which may render difficulties in applying of the solder paste for soldering operation, thereby resulting in undesired defect rate of the product since the solder paste itself is relatively slim in thinness.

The object of the present invention is to provide an electronic connector, more particularly a memory card connector with a new design for receiving double memory cards. The memory card connector is free from the undesired defect rate encountered during use of the conventional memory card connector.

SUMMARY OF THE INVENTION

One aspect of the present invention is to solve the uneven of the solder feet of the terminal along a horizontal line during fabrication of the prior art memory card connector so as to remedy the problem of undesired defect rate of the product. A support member with a curved top portion is implemented in the present invention to support a curved sliding groove in an insulated body such that such that the insulated body is disposed floatingly on the support member.

Another aspect of the present invention is to mount two rows of first terminals respectively on two side walls of the insulated body confining the curved sliding groove such that the solder feet of the first terminals are generally aligned with one another along a horizontal line due to the floatingly disposal of the insulated body on the support member. The solder feet of the first terminals are also aligned with the solder feet of two rows of second terminals that are press-fitted to two external surfaces of a bottom seat, which is disposed below the insulated body and in which the support member is fixed therein. Under such a condition, the solder feet of the first and second terminals can be soldered successfully to the electrical contacts in a base board.

The electronic connector of the present invention includes at least one support member having a curved top portion; an insulated body disposed above the support member, having a lower part formed with a curved sliding groove for receiving the curved top portion of the support member such that the insulated body is disposed floatingly on the support member; and two rows of first terminals respectively press-fitted to two side walls of the lower part confining the curved sliding groove, the first terminals having solder feet exposed to bottoms of the two side walls of the lower part.

The electronic connector of the present invention further includes a bottom seat disposed below the insulated body and having opposite front and rear end portions respectively and securely provided with two of the support members, the insulated body having two curved sliding grooves disposed floatingly and respectively on the support members, thereby facilitating mounting of the insulated body on the support members.

The bottom seat further has a positioning rib that extends between the front and rear end portions thereof and that is adapted to be inserted into a loading port formed in a printed circuit board below the bottom seat, thereby temporarily contacting the solder feet of the two rows of first terminals with electrical contacts on the printed circuit board prior to conducting a soldering operation for fixing the two rows of first terminals in the bottom seat.

The bottom seat in fact is a frame body having a bottomless reception chamber for receiving the insulated body therein. The frame body further has two side walls interconnecting the front and rear end portions to define the bottomless reception chamber. The two rows of first terminals are confined in the reception chamber with the solder feet of the first terminals being exposed from bottom end of the reception chamber. The electronic connector of the present invention further includes two rows of second terminals respectively press-fitted to external surfaces of the two side walls of the frame body in alignment with the two rows of first terminals in the reception chamber. The second terminals have solder feet exposed from bottom of the two side walls of the frame body. Due to floatingly mounting of the insulated body on the support members, the solder feet of the first and second terminals are generally aligned with one another along a common direction prior to the soldering operation of the terminals on the printed circuit board, thereby greatly reducing the defect rate in the terminals of the electron connector of the present invention.

In the prior art electronic connector, there exists the problem of uneven alignment of the solder feet of the terminals along a common direction, thereby leading to failure when conducting the soldering operation of the terminals to the base board. In the present invention, the curved sliding groove in the insulated body is disposed floatingly over the curved top portion of the support members in the bottom seat such that the insulated body is uniformly and floatingly seated over the bottom seat. Two rows of terminals are press-fitted to two side walls of the insulated body confining the curved sliding groove and have solder feet disposed in position to be aligned with one another along a common line so as to avoid the uneven alignment in the prior art. Due to floatingly mounting of the insulated body on the bottom seat, the solder feet of the first terminals press-fitted on the side walls of the insulated body and the solder feet of the second terminals press-fitted on external surfaces of the bottom seat are aligned with one another along a common line, thereby facilitating soldering of these solder feet to electrical contacts on the base board. In other words, the electronic connector produced accordingly has lesser defect rate when compared to the prior art ones.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

The electronic connector 100 of the present invention is capable of receiving double memory cards 200 (see FIG. 5), and is generally mounted on a base board (usually a printed circuit board). When compared to the prior art ones, the present electronic connector 100 can minimize a mounting space and has solid structure.

Figure 1:
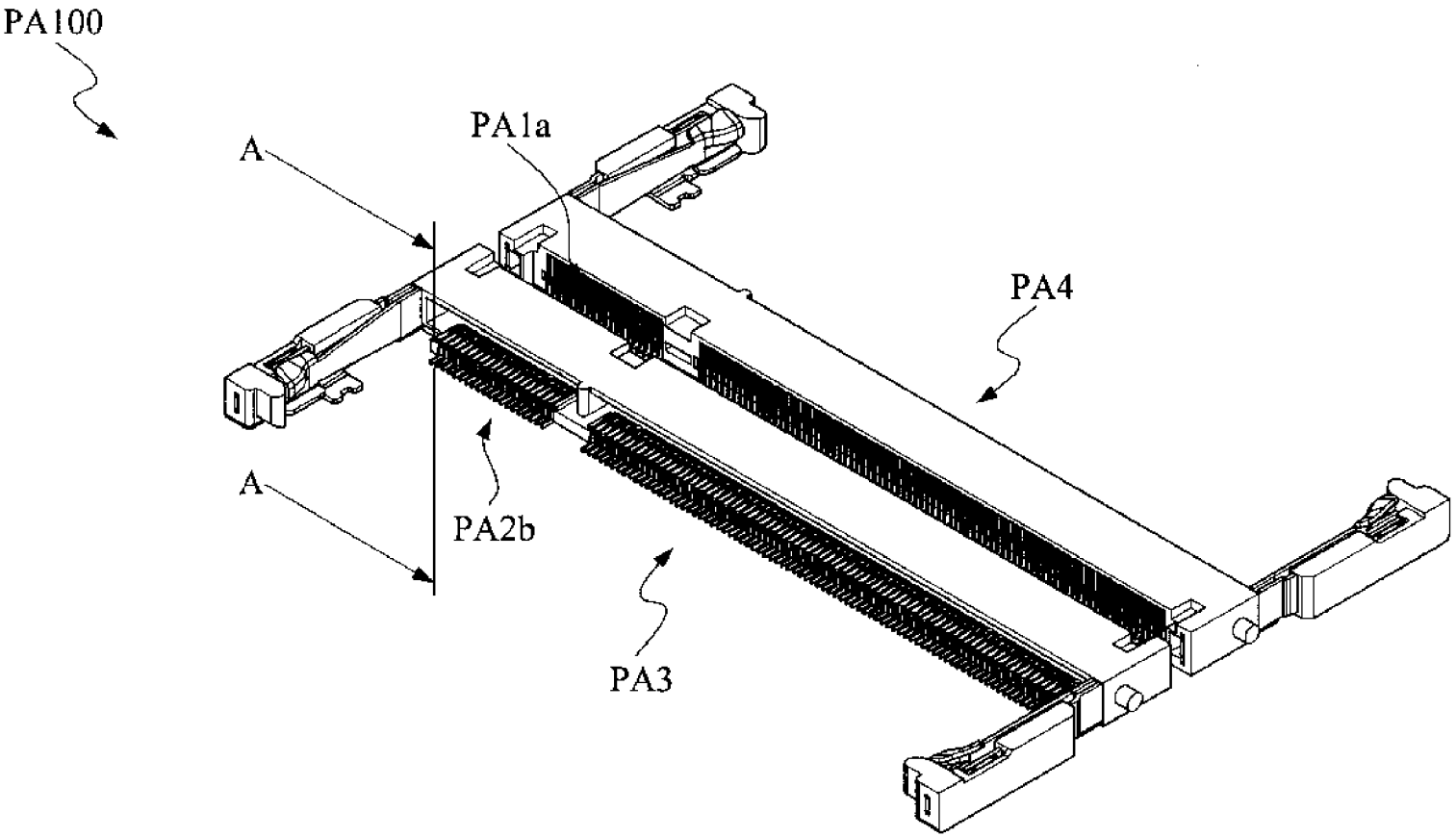
FIG.1(Prior Art)
FIG. 1 is a schematic view of a conventional electronic connector for receiving double memory cards therein.
Figure 1A:
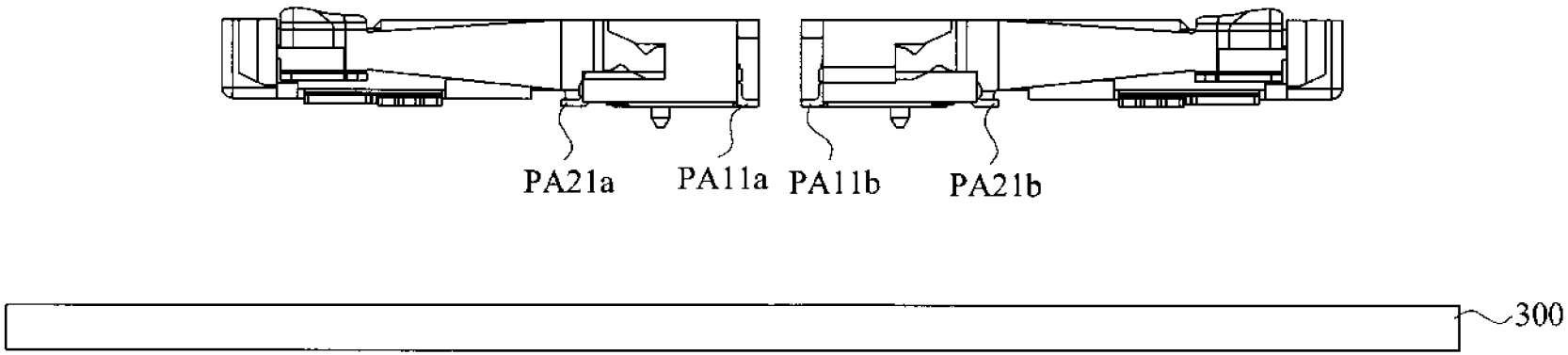
FIG.1A(Prior Art)
FIG. 1A is a cross-sectional view of the conventional electronic connector taken along lines A-A in FIG. 1 prior to soldering onto a base board.
Figure 2:
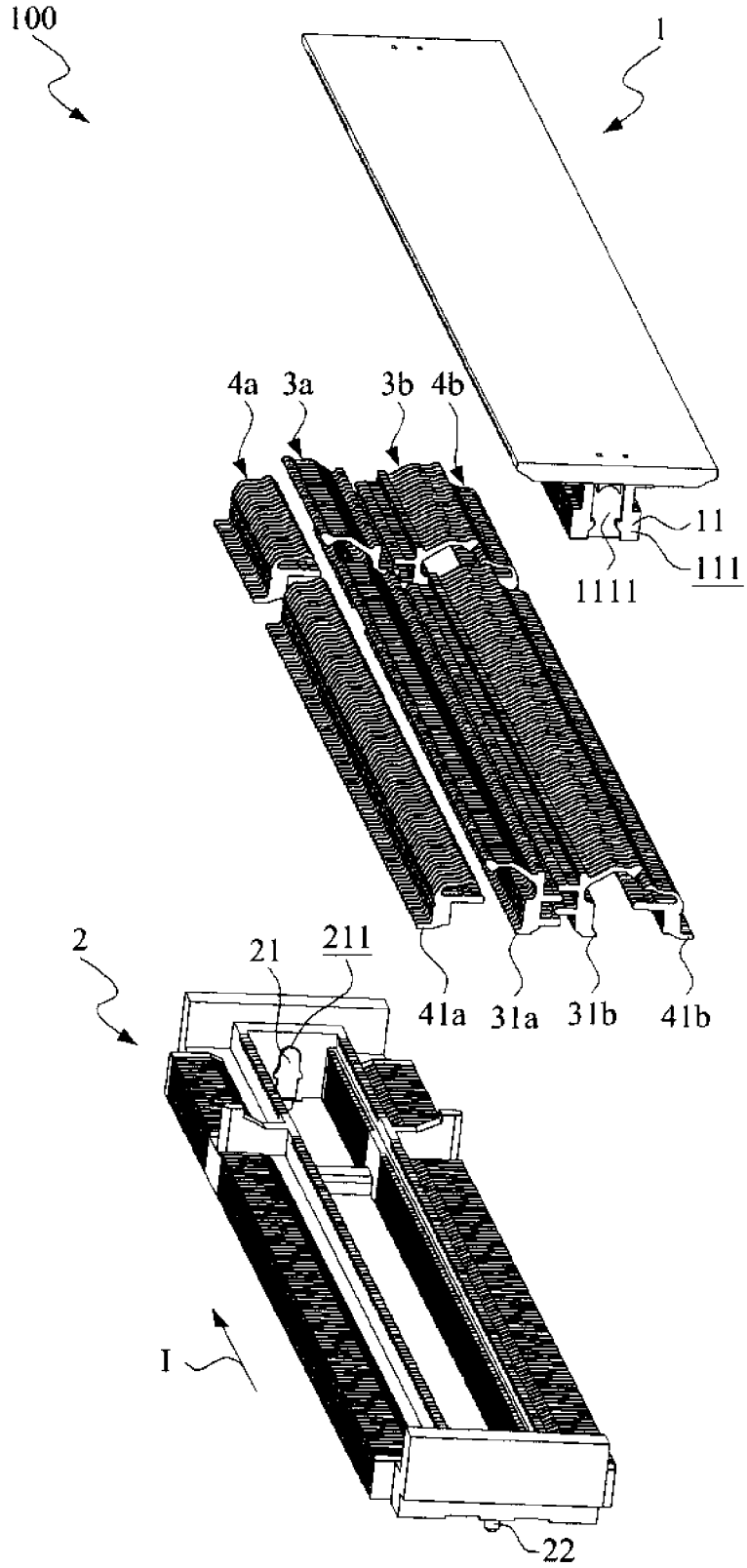
FIG. 2 is an exploded view of an electronic connector of the present invention.

FIG. 2 is an exploded view of one embodiment of the electronic connector 100 of the present invention, and includes an insulated body 1, two rows of first terminals 3*a*, 3*b*, two rows of second terminals 4*a*, 4*b* and a bottom seat 2. After assembly, two adjacent rows of first and second terminals 3*a*, 4*a* cooperatively define a first card loading port adapted to receive a first memory card 200 therein while another adjacent rows of first and second terminals 3*b*, 4*b* cooperatively define a second card loading port adapted to receive a second memory card 200 therein (see FIG. 5).

The insulated body 1 is generally made from insulating materials, and includes a lower part 11 projecting downwardly from a horizontal plate. Thus, the insulated body 1 is generally T-shaped in cross-section. The lower part 11 has two side walls 111 defining a curved sliding groove 1111 therebetween and extending along the longitudinal length of the horizontal plate, the purpose of which will be explained latter.

The side walls 111 of the lower part 11 are formed with a plurality of slits, where two rows of first terminals 3*a*, 3*b* respectively press-fitted thereto. The bottom seat 2 is disposed below the insulated body 1, is in fact a frame body having a bottomless reception chamber for receiving the lower part 11 of the insulated body 1. In other words, two rows of first terminals 3*a*, 3*b* are confined in the reception chamber in such a manner that the solder feet 31*a*, 31*b* of the first terminals 3*a*, 3*b* are exposed from the bottom of the reception chamber, i.e., the solder feet 31*a*, 31*b* of the first terminals 3*a*, 3*b* are exposed to bottoms of the side walls 111 of the lower part 11.

The frame body 2 has opposite front and rear end portions, a positioning rib 22 that extends between the front and rear end portions thereof and that is adapted to be inserted into a loading port 400 formed in a printed circuit board 300 (see FIG. 5), thereby temporarily contacting solder feet of the two rows of first terminals 3*a*,3*b* with electrical contacts on the printed circuit board 300 prior to conducting a soldering operation for fixing the two rows of first terminals 3*a*,3*b* in the bottom seat 2. Preferably, the reception chamber is confined by a chamber-defining wall having opposite sides serving as the front and rear end portions respectively.

Figure 3:
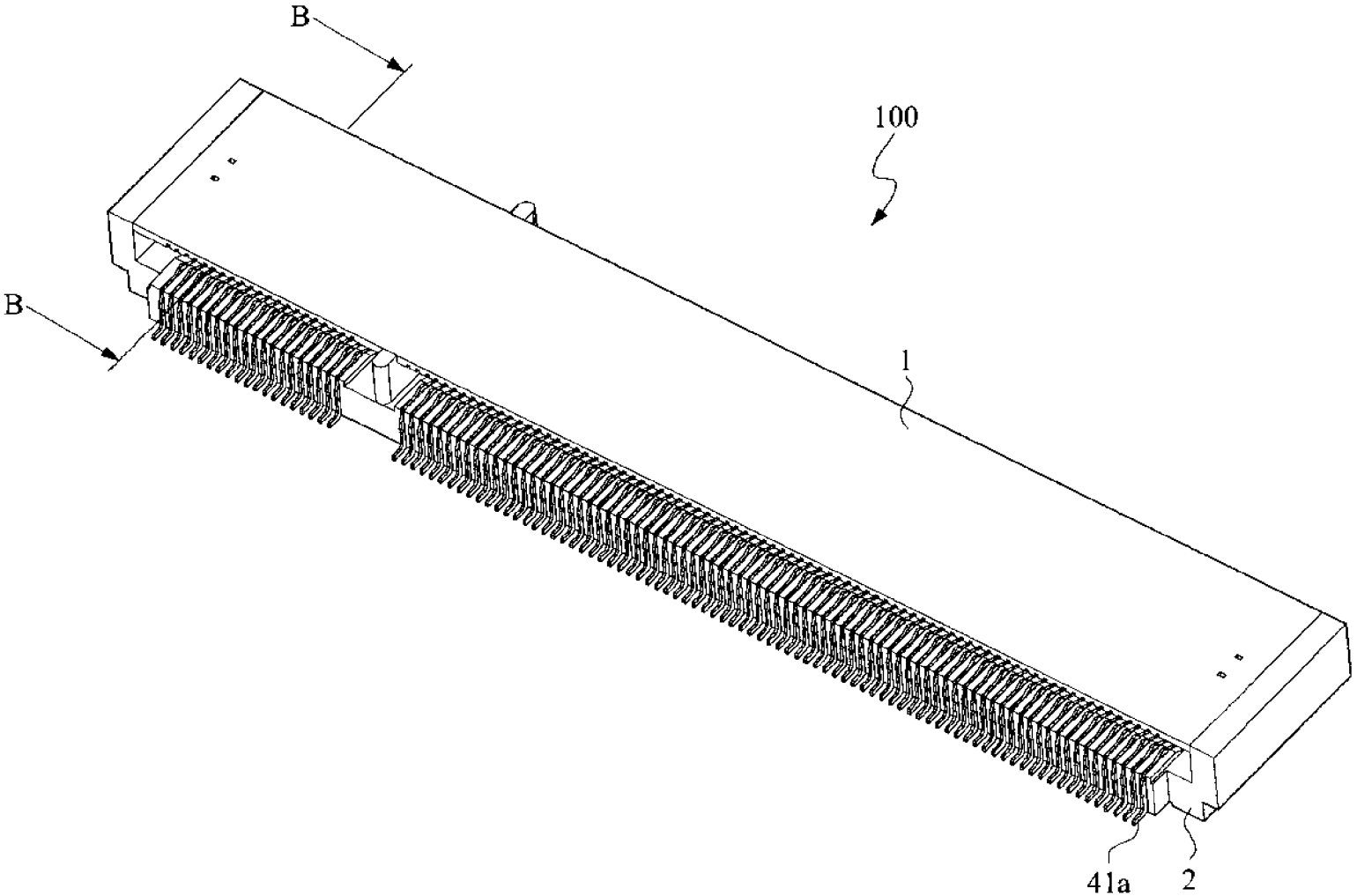
FIG. 3 shows a perspective view of the electronic connector of the present invention.

FIG. 3 shows a perspective top side view of the electronic connector 100 of the present invention, wherein only one row of second terminals 4*a* is visible in the drawing. In the present invention, the insulated body 1 is mounted floatingly on the frame body 2, while two rows of the second terminals 4*a*, 4*b* are press-fitted respectively to external surfaces of two side walls interconnecting the front and rear end portions to confine the reception chamber in the frame body 2 such that the solder feet 41*a*, 41*b* of the second terminals 4*a*, 4*b* are exposed from bottom of the side walls of the frame body 2.

Referring again to FIG. 2, during production of the electronic connector 100 of the present invention, in order to mount the insulated body 1 floatingly on the frame body 2, two support members 21 are fixed securely to opposite front and rear end portions of the frame body 2. Each of the support members 21 has a curved top portion 211 inserted floatingly the curved sliding grooves in the lower part 11 of the insulated body 1. Under this condition, the insulated body 1 is floatingly and stably disposed over the frame body 2, thereby disposing the solder feet 31*a*, 31*b* of the first terminals 3*a*, 3*b* generally aligned with one another along a horizontal line due to the floatingly disposal of the insulated body 1 on the support members 21. In this embodiment, two curved sliding groove 1111 of minor length can be formed at two opposite ends of the lower part 11 for receiving the curved top portions 211 of the support members 21 respectively.

Once the two rows of second terminals 4*a*, 4*b* are press-fitted to the external surfaces of the side walls of the frame body 2, the second terminals 4*a*, 4*b* are in alignment respectively with the first terminals in the reception chamber while the solder feet 41*a*, 41*b* are generally aligned with the solder feet 31*a*, 31*b* of the first terminals 3*a*, 3*b*, thereby facilitating soldering of these solder feet 31*a*, 31*b*, 41*a*, 41*b* to electrical contacts on the base board. In other words, the electronic connector 100 produced accordingly has lesser defect rate when compared to the prior art ones.

Figure 4:
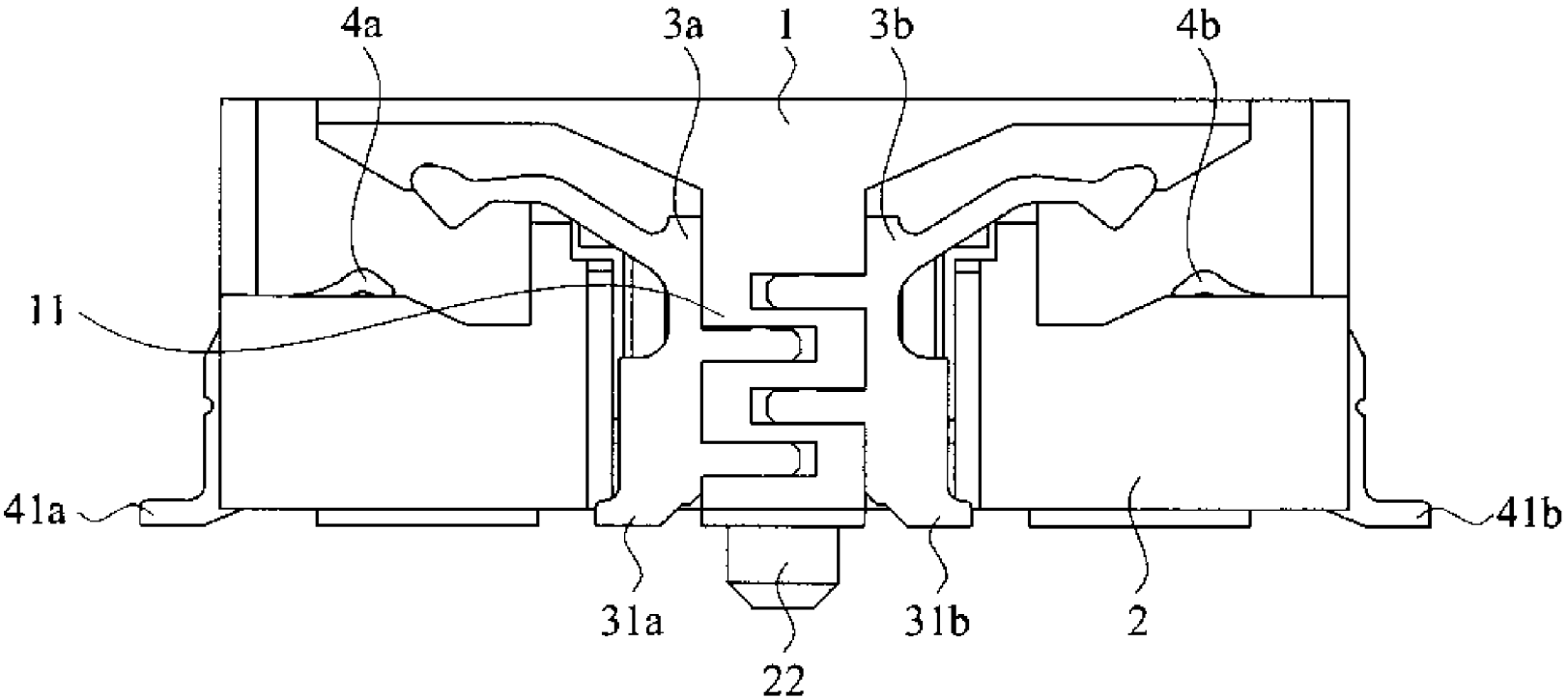
FIG. 4 is a cross-sectional view of the electronic connector of the present invention taken along lines B-B in FIG. 3.

FIG. 4 is a cross-sectional view of the electronic connector of the present invention taken along lines B-B in FIG. 3. As illustrated, the two rows of first terminals 3*a*, 3*b* are respectively press-fitted to two side walls 111 of the lower part 11 confining the curved sliding groove 1111. After assembly, the first terminals 3*a*, 3*b* are confined in the reception chamber of the frame body 2, and have the solder feet 31*a*, 31*b* exposed to bottoms of the reception chamber.

The two rows of second terminals 4*a*, 4*b* are respectively press-fitted to the external surfaces of the two side walls interconnecting the front and rear end portions to define the reception chamber in the frame body 2. The two rows of second terminals have solder feet 41*a*, 41*b* exposed from bottom of the side walls of the frame body 2.

The frame body 2 further has a positioning rib 22 that extends between the front and rear end portions thereof and that is adapted to be inserted into a loading port 400 formed in the printed circuit board 300, thereby temporarily contacting the solder feet 31*a*, 31*b* of the two rows of first terminals 3*a*,3*b* with electrical contacts on the printed circuit board 300 prior to conducting a soldering operation for fixing the two rows of first terminals 3*a*,3*b* in the frame body 2.

Figure 5:
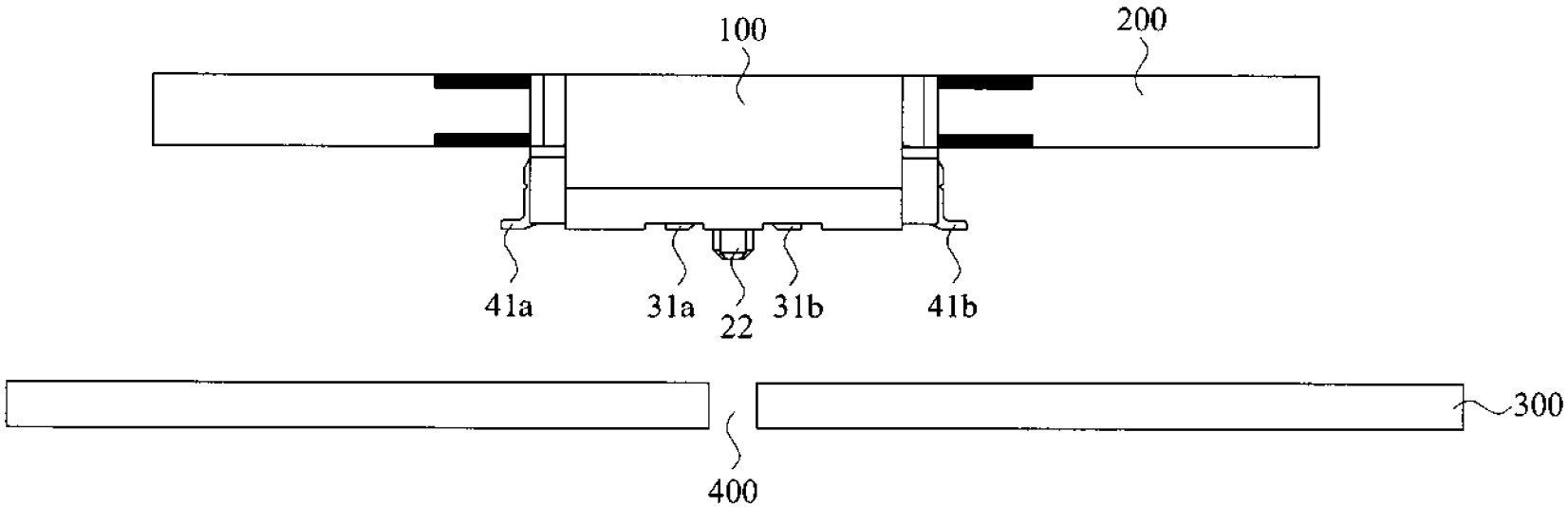
FIG. 5 is a front side view of the electronic connector of the present invention prior to soldering onto a base board.

FIG. 5 is a front side view of the electronic connector 100 of the present invention prior to soldering onto a printed circuit board 300 and in which two memory cards 200 are inserted at two sides thereof. Due to floatingly mounting of the insulated body on the bottom seat, the solder feet of the first and second terminals are aligned with one another along a common line, thereby avoiding the problem of unevenness of these solder feet encountered in the prior art technology. In other words, the electronic connector produced accordingly has lesser defect rate when compared to the prior art ones.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electronic connector comprising:

at least one support member having a curved top portion;

an insulated body disposed above said support member, having a lower part formed with a curved sliding groove for receiving said curved top portion of said support member such that said insulated body is disposed floatingly on said support member; and two rows of first terminals respectively press-fitted to two side walls of said lower part confining said curved sliding groove, said two rows of first terminals having solder feet exposed to bottoms of said two side walls of said lower part.

2. The electronic connector according to claim 1, further comprising a bottom seat disposed below said insulated body and having opposite front and rear end portions respectively and securely provided with two of said support members, said insulated body having two of said curved sliding grooves disposed floatingly and respectively on said support members.

3. The electronic connector according to claim 2, wherein said bottom seat is a frame body having a bottomless reception chamber for receiving said insulated body therein, said reception chamber being confined by a chamber-defining wall, said support members being fixed securely to opposite sides of said chamber-defining wall.

4. The electronic connector according to claim 2, wherein said bottom seat has a positioning rib that extends between said front and rear end portions thereof and that is adapted to be inserted into a loading port formed in a printed circuit board, thereby temporarily contacting solder feet of said two rows of first terminals with electrical contacts on said printed circuit board prior to conducting a soldering operation for fixing said two rows of first terminals in said bottom seat.

5. The electronic connector according to claim 3, wherein said solder feet of said two rows of first terminals are exposed from two bottom sides of said bottom seat.

6. The electronic connector according to claim 5, wherein said frame body of said bottom seat further has two side walls interconnecting said front and rear end portions to define said bottomless reception chamber, said two rows of first terminals being confined in said reception chamber with said solder feet of said two rows of first terminals being exposed from bottom end of said reception chamber, the electronic connector further comprising two rows of second terminals respectively press-fitted to external surfaces of said two side walls of said frame body in alignment with said two rows of first terminals in said reception chamber, said two rows of second terminals having solder feet exposed from bottom of said two side walls of said frame body.

7. The electronic connector according to claim 6, wherein two adjacent rows of first and second terminals cooperatively define a first card loading port adapted to receive a first memory card therein while another adjacent rows of first and second terminals cooperatively define a second card loading port adapted to receive a second memory card therein.

* * * * *